United States Patent [19]

Murata

[11] 4,123,641

[45] Oct. 31, 1978

[54] PUSHBUTTON SWITCH

[75] Inventor: Taneo Murata, Tokyo, Japan

[73] Assignee: Alps Electric Co., Ltd., Japan

[21] Appl. No.: 769,055

[22] Filed: Feb. 16, 1977

[30] Foreign Application Priority Data

Feb. 27, 1976 [JP] Japan ..... 51-22911[U]

[51] Int. Cl.[2] ..... H01H 3/12

[52] U.S. Cl. ..... 200/340; 403/377; 400/495

[58] Field of Search ..... 200/340; 197/102; 16/121; 30/342, 343; 403/361

[56] References Cited

U.S. PATENT DOCUMENTS

| | | | |
|---|---|---|---|
| 2,269,208 | 1/1942 | Kimball | 403/377 X |
| 2,304,036 | 12/1942 | Tegarty | 197/102 UX |
| 2,350,787 | 6/1944 | Martin et al. | 197/102 X |
| 2,470,723 | 5/1949 | Roche | 30/343 UX |
| 2,877,490 | 3/1959 | Greninger | 16/121 |

FOREIGN PATENT DOCUMENTS

| | | | |
|---|---|---|---|
| 266,970 | 12/1968 | Austria | 200/340 |
| 164,986 | 11/1905 | Fed. Rep. of Germany | 30/342 |

*Primary Examiner*—Daniel Blum

*Attorney, Agent, or Firm*—Guy W. Shoup; Gerard F. Dunne

[57] ABSTRACT

A pushbutton switch is disclosed which includes a pushbutton formed of a synthetic resin to have a recess, and a lever having an attachment portion for fitting into the recess. The lever is formed of a synthetic resin relatively harder than the material of the pushbutton and relatively small in creep contraction rate. The attachment portion has projections thrusting into the wall of the recess so as to prevent the lever from coming out of the recess.

3 Claims, 5 Drawing Figures

Fig. 1a.
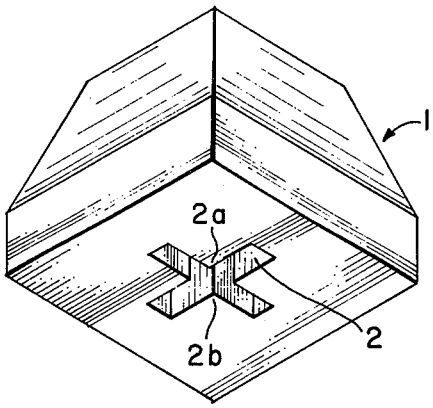
Fig. 2
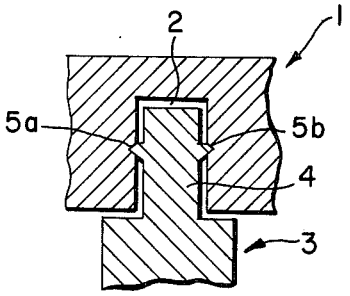
Fig. 3
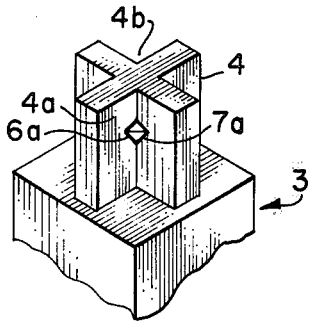
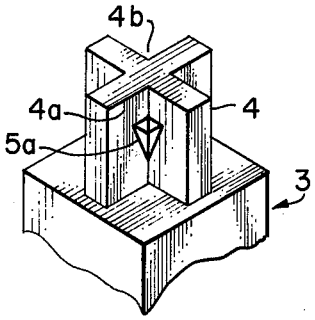
Fig. 1b.
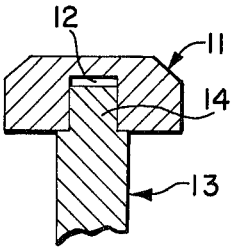
Fig. 4

PUSHBUTTON SWITCH

BACKGROUND OF THE INVENTION

The invention relates to a pushbutton switch for use in a table electronic calculator, a terminal device, or the like and, more partucularly, to an attachment of the pushbutton and the lever of the pushbutton switch in which the lever is forced to fit into a recess formed in the pushbutton.

Conventionally, a synthetic-resin made lever has been formed to have its attachment portion forced to fit into the recess formed in a synthetic-resin made pushbutton so as to attach the lever to the pushbutton. In such attachment, however, the lever has a tendency to become loose and come out of the recess of the pushbutton as the lever is subject to creep and deforms with the passage of time.

Therefore, it is an object of the present invention to provide an improved attachment of the lever and the pushbutton of a pushbutton switch which is effective to prevent the lever from coming out of the recess of the pushbutton.

Another object of the present invention is to provide an improved attachment which is simple in construction and which is free from the above-mentioned and other disadvantages.

In accordance with the present invention, there is provided a pushbutton switch including a pushbutton formed with a recess, and a lever having an attachment portion forced to fit into the recess, the switch comprising the pushbutton formed of a synthetic resin, the lever formed of a synthetic resin relatively harder than the material of the pushbutton and relatively small in creep contraction rate, and projections attached or integrally formed on the attachment portion of the lever. When the attachment portion is forced to fit into the recess, the projections thrust into the recess wall so as to prevent the lever from coming out of the recess due to the deformation of the recess and the attachment portion with the passage of time.

BRIEF DESCRIPTION OF THE DRAWINGS

The invention will be described in greater detail by reference to the following description taken in connection with the accompanying drawings, in which:

FIGS. 1*a* and 1*b* are perspective views of the pushbutton and the lever, respectively, in accordance with the present invention;

FIG. 2 is a sectional view taken along a diagonal line with the attachment portion of the lever shown in full engagement with the recess of the pushbutton;

FIG. 3 is a perspective view of the lever of an alternative embodiment of the present invention; and FIG. 4 is a sectional view showing the conventional attachment of the lever and the pushbutton.

DESCRIPTION OF THE PREFERRED EMBODIMENTS

Referring to FIG. 4, there is illustrated a conventional attachment of a pushbutton 11 and a lever 13. The lever 13 is formed to have its attachment portion 14 forced into close engagement with a recess 12 formed in the pushbutton 11. This attachment has a disadvantage in that the lever 13 may become loose and come out of the recess 12 of the pushbutton 11 as the lever 13 is subject to creep and deforms with the passage of time.

FIGS. 1*a*, 1*b* and 2 show an improved attachment of a pushbutton 1 and a lever 3 which is capable of eliminating the above disadvantage found in the conventional one. The pushbutton 1 is formed of a synthetic resin such as ABS synthetic resin and is formed in its undersurface with a cross-shaped recess 2. The lever 3 is formed of a synthetic resin relatively harder than the material of the pushbutton 1 and small in creep contraction rate, such as Duracon, a trademark of the Polyplastics Company, Ltd. of Osaka, Japan. The lever 3 has an attachment portion 4*a* of cross-shape in section as shown in FIG. 1*b*, which is forced to fit into the recess 2 of the pushbutton 1. The attachment portion 4 has its corners 4*a* and 4*b* provided with diamond-shaped projections 5*a* and 5*b* each with its tip end pointed.

When the attachment portion 4 is forced to fit into the recess 2 of the pushbutton 1, it, particularly the projections 5*a* and 5*b*, strongly presses against the inner wall of the recess 2. With the passage of time, the recess becomes expanded in the direction of the recess being pressed, whereas the attachment portion 4 is contracted due to creep. As a result, the attachment thereof becomes loose and has its strength reduced. However, since the pushbutton 1 and the lever 3 are different in deformation rate and the expansion rate of the recess 2 is larger than the contraction rate of the attachment portion 4, the projections 5*a* and 5*b* remain thrusting into the edges 2*a* and 2*b* as shown in FIG. 2 so as to prevent the lever 3 from coming out of the recess 2. Thus, the lever 3 cannot be separated from the pushbutton 1 without a rather strong force.

FIG. 3 shows an alternative embodiment of the present invention in which tetrahedron-shaped projections 6*a* are provided on the corners 4*a* and 4*b* of the attachment portion 4 instead of the diamond-shaped projections 5*a* and 5*b*. The tetrahedron-shaped projections have respective ridgelines 7*a* thrusting into the edges 2*a* and 2*b* so as to prevent the lever 3 from comming out of the recess 2 of the pushbutton 1.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In a pushbutton switch including a pushbutton formed of a synthetic resin material and having a recess, and a lever having an attachment portion for fitting into said recess, the improvement comprising:

said recess being substantially cross-shaped, said attachment portion being substantially cross-shaped in cross section and complementary with said recess, and integral projections extending outwardly from the inner corners of said attachment portion to thrust into the wall of said recess, said lever being formed of a synthetic resin material relatively harder and relatively smaller in creep contraction rate than the material of said pushbutton, whereby over extended periods of use, said projections will be continually thrust into the wall of said recess.

2. A pushbutton switch as set forth in claim 1, wherein said projections each has a pointed tip to thrust into said recess wall.

3. A pushbutton switch as set forth in claim 1, wherein said projections each has a ridgeline to thrust into said recess wall.

* * * * *